US010115345B2

(12) United States Patent
Wang

(10) Patent No.: US 10,115,345 B2
(45) Date of Patent: Oct. 30, 2018

(54) PIXEL CIRCUIT, DRIVING METHOD THEREOF AND DISPLAY PANEL

(71) Applicants: BOE TECHNOLOGY GROUP CO., LTD., Beijing (CN); BEIJING BOE DISPLAY TECHNOLOGY CO., LTD., Beijing (CN)

(72) Inventor: Qiang Wang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/569,727

(22) PCT Filed: May 19, 2017

(86) PCT No.: PCT/CN2017/085059

§ 371 (c)(1),
(2) Date: Oct. 26, 2017

(87) PCT Pub. No.: WO2018/014645

PCT Pub. Date: Jan. 25, 2018

(65) Prior Publication Data

US 2018/0226015 A1 Aug. 9, 2018

(30) Foreign Application Priority Data

Jul. 22, 2016 (CN) ..... 2016 1 0587379

(51) Int. Cl.
*G09G 3/325* (2016.01)

(52) U.S. Cl.
CPC ..... *G09G 3/325* (2013.01); *G09G 2320/045* (2013.01)

(58) Field of Classification Search
CPC ..... G09G 2320/0247; G09G 2320/045; G09G 2310/061; G09G 2320/0233;
(Continued)

(56) References Cited

U.S. PATENT DOCUMENTS 8,902,208 B2 * 12/2014 Chung ..... G09G 3/3233 345/211
8,913,090 B2 * 12/2014 Chung ..... G09G 3/3208 345/690
(Continued)

FOREIGN PATENT DOCUMENTS

CN 1909046 A 2/2007
CN 1912978 A 2/2007
(Continued)

OTHER PUBLICATIONS

International Search Report and Written Opinion in PCT/CN2017/085059 dated Aug. 17, 2017, with English translation.
(Continued)

*Primary Examiner* — Vinh T Lam
(74) *Attorney, Agent, or Firm* — Womble Bond Dickinson (US) LLP

(57) ABSTRACT

A pixel circuit, a driving method thereof and a display panel are disclosed. In the pixel circuit, an initialization circuit is configured for outputting an initialization signal to a first node; a driving circuit is configured for initializing a second node through a first power signal, and outputting a driving current to a control circuit; a charging circuit is configured for outputting a data signal to the first node; a maintenance circuit is configured for maintaining a potential of the second node unchanged through the first power signal; and the control circuit is configured for receiving the driving current from the driving circuit and outputting it to a light emitting circuit so as to drive the light emitting circuit to emit light. Particularly, the maintenance circuit can maintain
(Continued)

the potential of the second node unchanged, thereby ensuring that the driving circuit can output a stable driving current circuit.

11 Claims, 3 Drawing Sheets

(58) Field of Classification Search
CPC ... G09G 2310/0272; G09G 2310/0297; G09G 2310/0254; G09G 3/3208; G09G 2300/0842; G09G 2300/0866; G09G 2320/0209; G09G 2320/0238; G09G 2320/0252; G09G 2310/0248; G09G 2300/0465; G09G 2320/0276; G09G 2352/00; G09G 3/3233; G09G 3/3283; G09G 3/3291; G09G 2300/0819; G09G 2300/0852; G09G 2300/0861; G09G 2310/0251; G09G 2310/027; G09G 2310/0289; G09G 2320/0223; G09G 2320/043; G09G 2330/02; G09G 3/325; H05B 33/0896; Y02B 20/36
See application file for complete search history.

(56) References Cited

U.S. PATENT DOCUMENTS 9,001,009 B2 * 4/2015 Choi ..... G09G 3/325 345/76
9,007,283 B2 * 4/2015 Choi ..... G09G 3/3233 327/91
9,013,374 B2 * 4/2015 Han ..... G09G 3/32 345/204
9,269,304 B2 * 2/2016 Qian ..... G09G 3/3258
9,330,596 B2 * 5/2016 Choi ..... G09G 3/3233
9,443,466 B2 * 9/2016 In ..... G09G 3/3233
9,529,467 B2 * 12/2016 Yang ..... G06F 3/0412
9,552,771 B2 * 1/2017 Jeon ..... G09G 3/3225
9,552,796 B2 * 1/2017 Lee ..... G09G 5/18
9,685,113 B2 * 6/2017 Chen ..... G09G 3/3233
9,691,348 B2 * 6/2017 Kim ..... G09G 5/02
9,728,133 B2 * 8/2017 Hu ..... G09G 3/3258
9,746,979 B2 * 8/2017 Yang ..... G09G 3/3233
9,786,723 B2 * 10/2017 Yang ..... H01L 27/323
9,842,537 B2 * 12/2017 Lim ..... G09G 3/3225
9,842,539 B2 * 12/2017 Hung ..... G09G 3/3233
9,875,706 B1 * 1/2018 Gong ..... G09G 3/3659
9,886,902 B2 * 2/2018 Park ..... G09G 3/3233
9,972,248 B2 * 5/2018 Yang ..... G09G 3/3258
9,978,312 B2 * 5/2018 Yang ..... G09G 3/3258
9,984,631 B2 * 5/2018 Park ..... G09G 3/3291
2007/0024540 A1 2/2007 Ryu et al.
2007/0035487 A1 2/2007 Ryu et al.
2008/0218497 A1 9/2008 Takahashi
2010/0013816 A1 1/2010 Kwak et al.
2012/0013597 A1 1/2012 Han
2012/0139961 A1 6/2012 Choi
2013/0093800 A1 4/2013 Shim et al.
2014/0146030 A1 5/2014 Lee et al.
2014/0168179 A1 * 6/2014 Chung ..... H05B 33/0896 345/205
2014/0312784 A1 * 10/2014 Yin ..... G09G 3/3208 315/172
2014/0327664 A1 * 11/2014 Kanda ..... G09G 3/3233 345/212
2015/0028766 A1 * 1/2015 Yang ..... G09G 3/3225 315/240
2015/0035448 A1 * 2/2015 Wang ..... G09G 3/3291 315/240
2015/0161931 A1 * 6/2015 Lee ..... G09G 3/3266 345/77
2015/0187269 A1 * 7/2015 Hu ..... G09G 3/3258 345/212
2015/0220186 A1 * 8/2015 Tan ..... G06F 3/0412 345/174
2015/0221251 A1 8/2015 Wang
2015/0287359 A1 * 10/2015 Qing ..... G09G 3/3233 345/214
2015/0294624 A1 * 10/2015 Liu ..... G09G 3/3233 345/690
2015/0364087 A1 * 12/2015 Gu ..... G09G 3/3233 345/78
2015/0371590 A1 * 12/2015 Jeong ..... G09G 3/3291 345/213
2016/0035282 A1 * 2/2016 Lu ..... H05B 33/0896 315/291
2016/0055792 A1 * 2/2016 Lee ..... G09G 3/3233 315/173
2016/0155387 A1 * 6/2016 Kim ..... G09G 3/3291 345/76
2016/0189606 A1 * 6/2016 Chen ..... G09G 3/3233 345/214
2016/0260377 A1 9/2016 Hu
2016/0260380 A1 * 9/2016 Yang ..... G09G 3/32
2016/0307504 A1 * 10/2016 Hung ..... G09G 3/3233
2016/0307509 A1 * 10/2016 Nie ..... G09G 3/3258
2016/0321996 A1 * 11/2016 Lee ..... G09G 3/3258
2016/0365030 A1 * 12/2016 Wu ..... G09G 3/3258
2017/0005156 A1 * 1/2017 Kim ..... H01L 27/3262
2017/0025062 A1 * 1/2017 Wang ..... G09G 3/3233
2017/0069264 A1 3/2017 Dai et al.
2017/0076671 A1 * 3/2017 Kim ..... G09G 3/3233
2017/0124941 A1 * 5/2017 Na ..... G09G 3/2092
2017/0193910 A1 * 7/2017 Chen ..... G09G 3/3258
2017/0294161 A1 * 10/2017 Sun ..... G09G 3/3233
2017/0358259 A1 * 12/2017 Chung ..... G09G 3/3233
2017/0365215 A1 * 12/2017 He ..... G09G 3/3233
2018/0068628 A1 * 3/2018 Xiao ..... G09G 3/3677
2018/0102090 A1 * 4/2018 Han ..... G09G 3/3233
2018/0137814 A1 * 5/2018 Yang ..... G09G 3/3233

FOREIGN PATENT DOCUMENTS

CN 101261808 A 9/2008
CN 101630481 A 1/2010
CN 101814268 A 8/2010
CN 102339586 A 2/2012
CN 103050082 A 4/2013
CN 103226931 A 7/2013
CN 104269133 A 1/2015
CN 105185304 A 12/2015
CN 105632403 A 6/2016
CN 106023891 A 10/2016

OTHER PUBLICATIONS

Office Action received for Chinese Patent Application No. 201610587379.X, dated Jan. 3, 2018, 13 pages (7 pages of English Translation and 6 pages of Office Action).

* cited by examiner

PIXEL CIRCUIT, DRIVING METHOD THEREOF AND DISPLAY PANEL

RELATED APPLICATIONS

The present application is the U.S. national phase entry of PCT/CN2017/085059, with an international filing date of May 19, 2017, which claims the benefit of Chinese Patent Application No. 201610587379.X, filed on Jul. 22, 2016, the entire disclosures of which are incorporated herein by reference.

FIELD OF THE INVENTION

This disclosure relates to the field of display technology, particularly to a pixel circuit, a driving method thereof and a display panel.

BACKGROUND OF THE INVENTION

With development of the display technology, high resolution and low cost of the display product is the important development direction of the current display product. However, with increase of the resolution of the display product, an area occupied by each pixel on the display panel becomes smaller, so that a storage capacitor in the pixel circuit becomes smaller, and thus compensation characteristic of the pixel circuit is degraded. Likewise, in order to reduce production cost of the display product, the number of mask plates in the manufacturing process of the display panel might be reduced generally, i.e., the manufacturing process steps are simplified. The reduction of the mask plates, i.e., the simplification of patterning process steps, enables the storage capacitor in the pixel circuit to be made of a metal layer (i.e., a gate) and an active layer (i.e., a source-drain). In this case, medium thickness of the storage capacitor can be determined by means of the metal layer and the active layer, and is thus large. In this way, the storage capacitor in the pixel circuit may also be small, thereby resulting in a poor compensation characteristic of the pixel circuit.

Therefore, there is a requirement of improving the compensation characteristic of the pixel circuit.

SUMMARY OF THE INVENTION

According to an aspect of this disclosure, a pixel circuit is provided. The pixel circuit comprises: an initialization circuit for outputting an initialization signal to a first node in an initialization phase; a driving circuit for initializing a second node through a first power signal in the initialization phase and outputting a driving current to a control circuit in a light emitting phase; a charging circuit for outputting a data signal to the first node in a data writing phase; the control circuit for receiving the driving current from the driving circuit and outputting it to a light emitting circuit in a light emitting phase; and the light emitting circuit for receiving the driving current from the control circuit to emit light, and wherein the pixel circuit further comprises: a maintenance circuit for maintaining a potential of the second node through the first power signal in the light emitting phase.

In one embodiment, the initialization circuit comprises a control terminal for receiving a first control signal, an input terminal for receiving the initialization signal and an output terminal connected with the first node, and the initialization circuit outputs the initialization signal to the first node under the control of the first control signal. The charging circuit comprises a control terminal for receiving a second control signal, an input terminal for receiving the data signal and an output terminal connected with the first node, and the charging circuit outputs the data signal to the first node under the control of the second control signal. The maintenance circuit comprises a control terminal for receiving a third control signal, an input terminal for receiving the first power signal, and an output terminal connected with the second node, and the maintenance circuit maintains the potential of the second node through the first power signal under the control of the third control signal. The driving circuit comprises a first control terminal connected with the second node, a second control terminal for receiving the first control signal, a first input terminal for receiving the first power signal, a second input terminal connected with the first node, an output terminal connected with the control circuit, and the driving circuit initializes the second node through the first power signal under the control of the first control signal, and outputs the driving current to the control circuit under the control of the second node. The control circuit comprises a control terminal for receiving the third control signal, an input terminal for receiving the driving current from the driving circuit, and an output terminal connected with the light emitting circuit, and the control circuit outputs the driving current outputted by the driving circuit to the light emitting circuit under the control of the third control signal so as to drive the light emitting circuit to emit light. The light emitting circuit comprises a first input terminal for receiving the driving current from the control circuit, and a second input terminal for receiving the second power signal, and the light emitting circuit emits light under the control of the driving current.

In one embodiment, the maintenance circuit comprises a first switch transistor and a maintenance capacitor. A gate of the first switch transistor is configured for receiving the third control signal, a source of the first switch transistor is configured for receiving the first power signal, and a drain of the first switch transistor is connected with one of two electrodes of the maintenance capacitor, and the other of the two electrodes of the maintenance capacitor is connected with the second node.

In one embodiment, one of the two electrodes of the maintenance capacitor is arranged on an electrode layer of the first switch transistor, and the other of the two electrodes of the maintenance capacitor is arranged on a metal layer of the first switch transistor.

In one embodiment, the charging circuit comprises a second switch transistor. A gate of the second switch transistor is configured for receiving the second control signal. A source of the second switch transistor is configured for receiving the data signal, and a drain of the second switch transistor is connected with the first node.

In one embodiment, the initialization circuit comprises a third switch transistor. A gate of the third switch transistor is configured for receiving the first control signal. A source of the third switch transistor is configured for receiving the initialization signal, and a drain of the third switch transistor is connected with the first node.

In one embodiment, the driving circuit comprises a fourth switch transistor, a fifth switch transistor and a storage capacitor. A gate of the fourth switch transistor is configured for receiving the first control signal. A source of the fourth switch transistor is connected with a drain of the fifth switch transistor and the input terminal of the control circuit. A drain of the fourth switch transistor is connected with the second node, one of two electrodes of the storage capacitor and a gate of the fifth switch transistor. A source of the fifth switch transistor is configured for receiving the first power signal, and the other of the two electrodes of the storage capacitor is connected with the first node.

In one embodiment, the control circuit comprises a sixth switch transistor. A gate of the sixth switch transistor is configured for receiving the third control signal, a source of the sixth switch transistor is connected with the output terminal of the driving circuit, and a drain of the sixth switch transistor is connected with the input terminal of the light emitting circuit.

In one embodiment, the maintenance circuit comprises a first switch transistor and a maintenance capacitor, the charging circuit comprises a second switch transistor, the initialization circuit comprises a third switch transistor, the driving circuit comprises a fourth switch transistor, a fifth switch transistor and a storage capacitor, and the control circuit comprises a sixth switch transistor. A gate of the first switch transistor is configured for receiving a third control signal, a source of the first switch transistor is configured for receiving the first power signal, and a drain of the first switch transistor is connected with one of two electrodes of the maintenance capacitor. The other of the two electrodes of the maintenance capacitor is connected with the second node. A gate of the second switch transistor is configured for receiving a second control signal, a source of the second switch transistor is configured for receiving the data signal, and a drain of the second switch transistor is connected with the first node. A gate of the third switch transistor is configured for receiving the first control signal, a source of the third switch transistor is configured for receiving the initialization signal, and a drain of the third switch transistor is connected with the first node. A gate of the fourth switch transistor is configured for receiving the first control signal, a source of the fourth switch transistor is connected with a drain of the fifth switch transistor and a source of the sixth switch transistor, and a drain of the fourth switch transistor is connected with the second node. A gate of the fifth switch transistor is connected with the second node, a source of the fifth switch transistor is configured for receiving the first power signal; the two electrodes of the storage capacitor are connected with the first node and the second node respectively. A gate of the sixth switch transistor is configured for receiving the third control signal, a drain of the sixth switch transistor is connected with the input terminal of the light emitting circuit. The output terminal of the light emitting circuit is configured for receiving a second power signal.

According to another aspect of this disclosure, a display panel is provided. The display panel comprises the pixel circuit as described above.

According to another aspect of this disclosure, a driving method of the pixel circuit as described above is provided. The driving method comprises: in the initialization phase, the initialization circuit outputting the initialization signal to the first node, and the driving circuit initializing the second node through the first power signal; in the data writing phase, the charging circuit outputting the data signal to the first node; and in the light emitting phase, the maintenance circuit maintaining the potential of the second node through the first power signal, the driving circuit outputting the driving current to the control circuit, and the control circuit outputting the driving current to the light emitting circuit so as to drive the light emitting circuit to emit light.

In one embodiment, in the initialization phase, the initialization circuit outputs the initialization signal to the first node under the control of the first control signal; and the driving circuit initializes the second node through the first power signal under the control of the first control signal. In the data writing phase, the charging circuit outputs the data signal to the first node under the control of the second control signal. In the light emitting phase, the maintenance circuit maintains the potential of the second node through the first power signal under the control of the third control signal; the driving circuit outputs the driving current to the control circuit under the control of the second node; and the control circuit outputs the driving current to the light emitting circuit under the control of the third control signal so as to drive the light emitting circuit to emit light.

In one embodiment, the first control signal, the second control signal and the third control signal are all low level signals.

In one embodiment, the driving method of the pixel circuit as described above comprises: (1) in the initialization phase, enabling the first control signal to be a low level signal; enabling the third switch transistor and the fourth switch transistor to be turned on under the control of the first control signal; the third switch transistor that is turned on outputting the initialization signal to the first node; the fourth switch transistor that is turned on enabling the fifth switch transistor to serve as a diode, so as to initialize the second node through the first power signal; (2) in the data writing phase, enabling the second control signal to be a low level signal; enabling the second switch transistor to be turned on under the control of the second control signal, the second switch transistor that is turned on outputting the data signal to the first node and charging the storage capacitor; (3) in the light emitting phase, enabling the third control signal to be a low level signal; enabling the first switch transistor and the sixth switch transistor to be turned on under the control of the third control signal; the first switch transistor that is turned on maintaining the potential of the second node through the first power signal and the maintenance capacitor; the sixth switch transistor that is turned on outputting the driving current outputted by the fifth switch transistor to the light emitting circuit, so as to drive the light emitting circuit to emit light.

Figure 1:
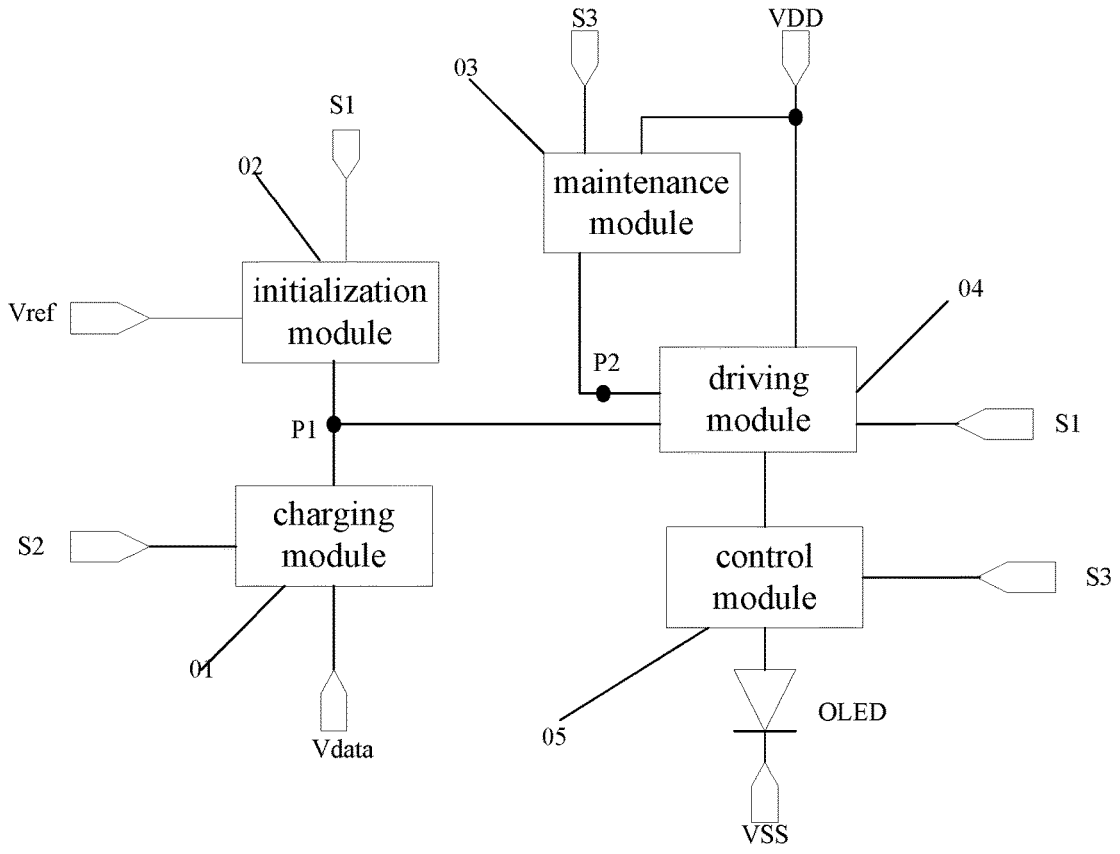
FIG. 1 is a structural schematic view of a pixel circuit provided according to an embodiment of this disclosure.

In the drawings, like reference signs represent similar or equal elements.

DETAILED DESCRIPTION OF THE INVENTION

There is provided a pixel circuit according to an embodiment of this disclosure, comprising: an initialization circuit for outputting an initialization signal to a first node in an initialization phase; a driving circuit for initializing a second node through a first power signal in the initialization phase, and outputting a driving current to a control circuit in a light emitting phase; a charging circuit for outputting a data signal to the first node in a data writing phase; a control circuit for receiving the driving current from the driving circuit and outputting it to a light emitting circuit in the light emitting phase; and the light emitting circuit for receiving the driving current from the control circuit to emit light. The pixel circuit further comprises: a maintenance circuit for maintaining a potential of the second node through the first power signal in the light emitting phase.

The pixel circuit provided according to an embodiment of this disclosure can implement a function of normally driving the light emitting circuit to emit light. In particular, according to this disclosure, the maintenance circuit can maintain the potential of the second node in the light emitting phase, thereby ensuring that the driving circuit outputs a stable driving current under the control of the stable second node so as to drive the light emitting circuit to emit light. This helps improving the compensation characteristic of the pixel circuit.

Based on the same inventive concept, an embodiment of this disclosure provides a display panel, comprising the above pixel circuit provided by an embodiment of this disclosure. The display panel can be applied in any product or component with a display function such as a mobile phone, a panel computer, a television, a display, a notebook, a digital photo frame, a navigator, and so on.

Based on the same inventive concept, an embodiment of this disclosure provides a driving method of the above pixel circuit, comprising: in an initialization phase, outputting, by the initialization circuit, the initialization signal to the first node, and initializing, by the driving circuit, the second node through the first power signal; in a data writing phase, outputting, by the charging circuit, the data signal to the first node; and in a light emitting phase, maintaining, by the maintenance circuit, a potential of the second node through the first power signal, outputting, by the driving circuit, the driving current to the control circuit, and outputting, by the control circuit, the driving current to the light emitting circuit to drive the light emitting circuit to emit light.

In the driving method of the above pixel circuit provided according to an embodiment of this disclosure, the first node and the second node are initialized and/or reset in the initialization phase, the data is written in the data writing phase, and the light emitting circuit is driven and is enabled to emit light in the light emitting phase. Particularly, through maintaining the potential of the second node by the maintenance circuit in the light emitting phase, it can be ensured that the driving circuit outputs a stable driving current under the control of the stable second node so as to drive the light emitting circuit to emit light. This helps improving the compensation characteristic of the pixel circuit.

The pixel circuit, the driving method thereof and the display panel according to embodiments of this disclosure are explained below in detail in connection with the drawings.

FIG. 1 illustrates a structural schematic view of a pixel circuit provided according to an embodiment of this disclosure. As shown in FIG. 1, the pixel circuit can comprise: a charging circuit 01, an initialization circuit 02, a maintenance circuit 03, a driving circuit 04, a control circuit 05 and a light emitting circuit OLED.

As shown in FIG. 1, the charging circuit 01 comprises a control terminal for receiving a second control signal S2, an input terminal for receiving a data signal Vdata and an output terminal connected with a first node P1. According to an embodiment of this disclosure, the charging circuit 01 outputs the data signal Vdata to the first node P1 under the control of the second control signal S2.

As shown in FIG. 1, the initialization circuit 02 comprises an output terminal connected with the first node P1, a control terminal for receiving a first control signal S1 and an input terminal for receiving an initialization signal Vref. According to an embodiment of this disclosure, the initialization circuit 02 outputs the initialization signal Vref to the first node P1 under the control of the first control signal S1.

As shown in FIG. 1, the maintenance circuit 03 comprises an output terminal connected with a second node P2, a control terminal for receiving a third control signal S3 and an input terminal for receiving a first power signal VDD. According to an embodiment of this disclosure, the maintenance circuit 03 maintains a potential of the second node P2 through the first power signal VDD under the control of the third control signal S3.

As shown in FIG. 1, the driving circuit 04 comprises a second input terminal connected with the first node P1, a first control terminal connected with the second node P2, an output terminal connected with the control circuit 05, a second control terminal for receiving the first control signal S1, and a first input terminal for receiving the first power signal VDD. According to an embodiment of this disclosure, the driving circuit 04 initializes the second node P2 through the first power signal VDD under the control of the first control signal S1, and outputs the driving current to the control circuit 05 under the control of the second node P2.

As shown in FIG. 1, the control circuit 05 comprises an input terminal for receiving the driving current from the driving circuit 04, an output terminal connected with a light emitting circuit OLED and a control terminal for receiving the third control signal S3. According to an embodiment of this disclosure, the control circuit 05 outputs the driving current outputted from the driving circuit 04 to the light emitting circuit OLED under the control of the third control signal S3, so as to drive the light emitting circuit OLED to emit light.

The light emitting circuit OLED comprises a first input terminal for receiving the driving current from the control circuit 05 and a second input terminal for receiving a second power signal VSS. Particularly, the light emitting circuit OLED emits light under the control of the driving current. The light emitting circuit OLED is for example an organic light emitting diode.

In the pixel circuit provided according to an embodiment of this disclosure, the first control signal S1, the second control signal S2, the third control signal S3, the first power signal VDD, the second power signal VSS, the initialization signal Vref and the data signal Vdata can be set as needed.

The pixel circuit provided according to an embodiment of this disclosure as shown in FIG. 1 can implement the normal function of driving the light emitting circuit to emit light, through the charging circuit, the initialization circuit, the maintenance circuit, the driving circuit and the control circuit. Particularly, through maintaining, by the maintenance circuit, the potential of the second node unchanged, it can be ensured that the driving circuit output a stable driving current under the control of the stable second node so as to drive the light emitting circuit to emit light. This helps improving the compensation characteristic of the pixel circuit. The pixel circuit provided according to an embodiment of this disclosure is applicable for a display product of high resolution, thereby being adapted to the development trend of high resolution and low cost of the display panel.

Figure 2:
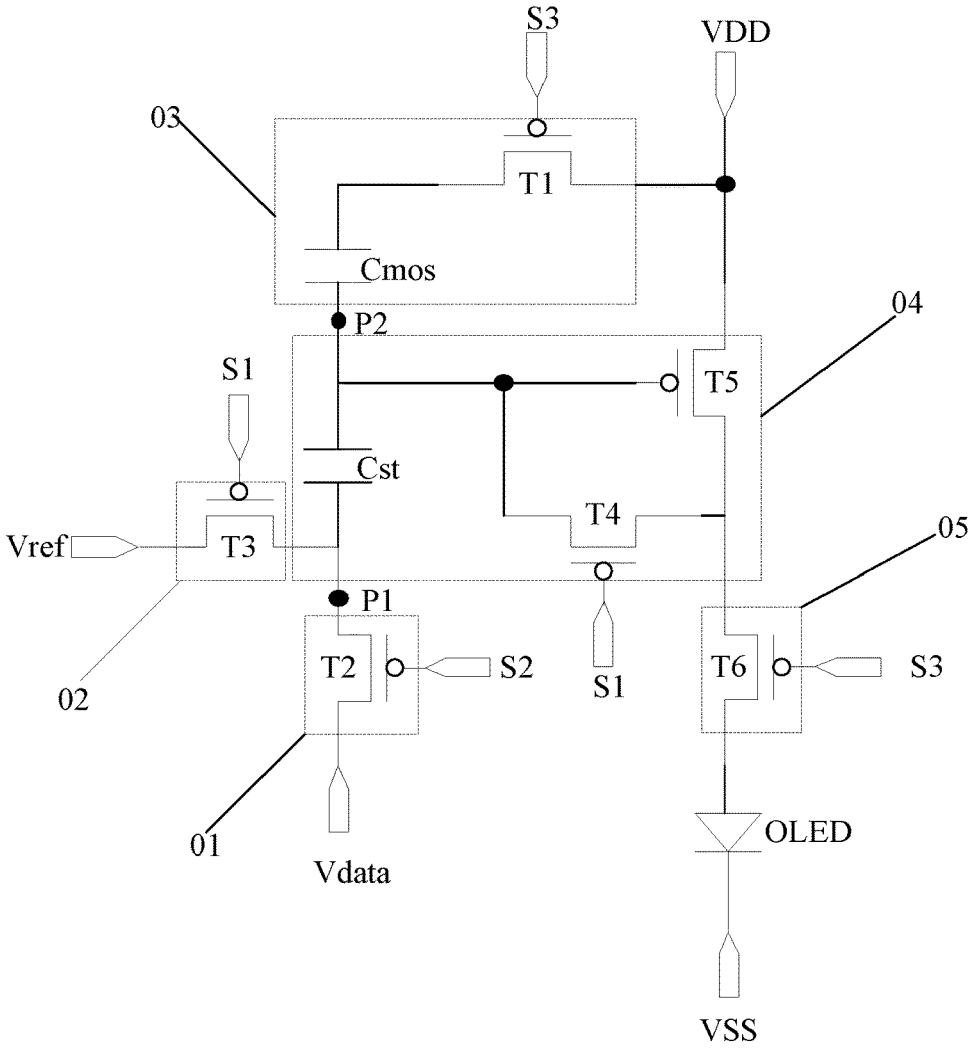
FIG. 2 is a structural schematic view that describes further details of the pixel circuit provided according to an embodiment of this disclosure in FIG. 1.

FIG. 2 is a structural schematic view that describes further details of the pixel circuit provided according to an embodiment of this disclosure in FIG. 1, in which dashed frames represent circuits of the pixel circuit.

As shown in FIG. 2, the maintenance circuit 03 can comprise a first switch transistor T1 and a maintenance capacitor Cmos. A gate of the first switch transistor T1 is configured for receiving the third control signal S3, a source of the first switch transistor T1 is configured for receiving the first power signal VDD, and a drain of the first switch transistor T1 is connected with one of two electrodes of the maintenance capacitor Cmos. The other of the two electrodes of the maintenance capacitor Cmos is connected with the second node P2. Particularly, the first switch transistor T1 can be turned on under the control of the third control signal S3. The first switch transistor T1 that is turned on can output the first power signal VDD to one of the two electrodes of the maintenance capacitor Cmos. In such a case, the maintenance capacitor Cmos can maintain a potential of the other (i.e., the second node) of the two electrode unchanged, according to the principle of charge conservation.

In one embodiment, one of the two electrodes of the maintenance capacitor Cmos is arranged on an active layer (i.e., the source-drain) of the first switch transistor T1, while the other of the two electrodes of the maintenance capacitor Cmos is arranged on a metal layer (i.e., the gate) of the first switch transistor T1. Because the maintenance capacitor Cmos can be arranged on existing layers of the switch transistor in the pixel circuit, additional manufacturing process is not required, thereby saving the manufacturing cost. In addition, in such a case, because the two electrodes of the maintenance capacitor are constituted by the active layer and the metal layer of the switch transistor respectively, the maintenance capacitor is a metal oxide semiconductor (MOS) capacitor.

Figure 3:
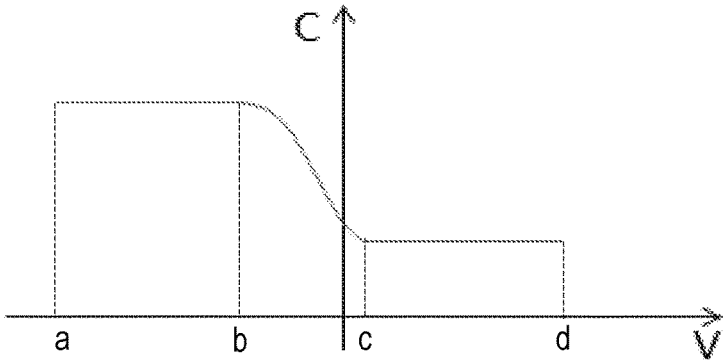
FIG. 3 is a curve schematic view that describes voltage-capacitance characteristic of a maintenance capacitor provided according to an embodiment of this disclosure.

FIG. 3 is a curve schematic view that describes capacitance-voltage characteristic of a maintenance capacitor Cmos according to an embodiment of this disclosure. As shown in FIG. 3, the capacitance value of the MOS capacitor varies with the change of the voltage within a fixed voltage range (i.e., between b and c). Outside this fixed voltage range (i.e., between a and b and between c and d), the capacitance value of the MOS capacitor is fixed, which does not vary with the change of the voltage. Hence, according to an embodiment of this disclosure, the capacitance value of the MOS capacitor can be set outside the above fixed voltage range, i.e., between a and b and between c and d. In one embodiment, the capacitance value of the MOS capacitor can be set between a and b. In this way, the capacitance value of the MOS remains unchanged. In order to enable the maintenance capacitor Cmos to maintain the potential of the second node P2 unchanged, the first switch transistor T1 that is turned on outputs the constant first power signal VDD to one of the two electrodes of the maintenance capacitor Cmos. In such a case, because the capacitance value of the maintenance capacitor Cmos remains unchanged, the potential of the other of its two electrodes would also be constant and remain unchanged, thereby maintaining the potential of the second node unchanged.

In the pixel circuit provided according to an embodiment of this disclosure, as shown in FIG. 2, the initialization circuit 02 can comprise a third switch transistor T3. A gate of the third switch transistor T3 is configured for receiving the first control signal S1, a source of the third switch transistor T3 is configured for receiving the initialization signal Vref, and a drain of the third switch transistor T3 is connected with the first node P1. Particularly, the third switch transistor T3 can be turned on under the control of the first control signal S1. The third switch transistor T3 that is turned on can output the initialization signal Vref to the first node P1, thereby realizing initialization and/or reset of the first node P1.

In the pixel circuit provided according to an embodiment of this disclosure, as shown in FIG. 2, the charging circuit 01 can comprise a second switch transistor T2. A gate of the second switch transistor T2 is configured for receiving the second control signal S2, a source of the second switch transistor T2 is configured for receiving the data signal Vdata, and a drain of the second switch transistor T2 is connected with the first node P1. Particularly, the second switch transistor T2 can be turned on under the control of the second control signal S2. The second switch transistor T2 that is turned on can output the data signal Vdata to the first node P1, thereby realizing writing of the data signal.

In the pixel circuit provided according to an embodiment of this disclosure, as shown in FIG. 2, the driving circuit 04 can comprise: a fourth switch transistor T4, a fifth switch transistor T5 and a storage capacitor Cst. A gate of the fourth switch transistor T4 is configured for receiving the first control signal S1, a source of the fourth switch transistor T4 is connected with a drain of the fifth switch transistor T5 and the input terminal of the control circuit 05, and a drain of the fourth switch transistor T4 is connected with the second node P2. A gate of the fifth switch transistor T5 is connected with the second node P2, a source of the fifth switch transistor T5 is configured for receiving the first power signal VDD, and the drain of the fifth switch transistor T5 is connected with the source of the fourth switch transistor T4 and the input terminal of the control circuit 05. The storage capacitor Cst is located between the first node P1 and the second node P2. One of two electrodes of the storage capacitor Cst is connected with P1 and the other of the two electrodes of the storage capacitor Cst is connected with P2. Particularly, the fourth switch transistor T4 can be turned on under the control of the first control signal S1. The fourth switch transistor T4 that is turned on enables the fifth switch transistor T5 to serve as a diode, thereby realizing initialization and/or reset of the second node P2. Thereafter, the fifth switch transistor T5 can be turned on under the control of the second node P2. The fifth switch transistor T5 that is turned on can output the driving current to the input terminal of the control circuit 05.

In the pixel circuit provided according to an embodiment of this disclosure, as shown in FIG. 2, the control circuit 05 can comprise a sixth switch transistor T6. In such a case, the input terminal of the control circuit 05 can be a source of the sixth switch transistor T6. As shown in FIG. 2, a gate of the sixth switch transistor T6 is configured for receiving the third control signal S3, a source of the sixth switch transistor T6 is connected with the output terminal of the driving circuit 04 (i.e., the drain of the fifth switch transistor T5 and/or the source of the fourth switch transistor T4), and a drain of the sixth switch transistor T6 is connected with the first input terminal of the light emitting circuit OLED. Particularly, the sixth switch transistor T6 can be turned on under the control of the third control signal S3. The sixth switch transistor T6 that is turned on can output the driving current outputted from the driving circuit 04 to the first input terminal of the light emitting circuit OLED, so as to drive the light emitting circuit OLED to emit light.

In the pixel circuit provided according to an embodiment of this disclosure, as shown in FIG. 2, the light emitting circuit OLED is an organic light emitting diode OLED. The first input terminal of the light emitting circuit OLED is connected with the sixth switch transistor T6 and the second input terminal of the light emitting circuit OLED is configured for receiving the second power signal VSS. Particularly, the light emitting circuit OLED emits light under the driving of the driving current outputted from the driving circuit 04.

It is noted that the switch transistor according to an embodiment of this disclosure can be either a thin film transistor (TFT) or a metal oxide semiconductor field effect transistor (MOS). In addition, the source and the drain of the transistor according to an embodiment of this disclosure can be interchangeably used. In this text, embodiments according to this disclosure are described by taking a thin film transistor as an example.

Figure 4:
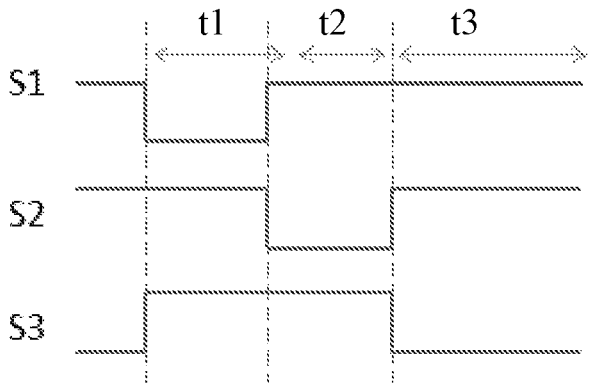
FIG. 4 is a schematic view of an operating sequence of a control signal for controlling the pixel circuit provided according to an embodiment of this disclosure.

The operation process of the pixel circuit provided by an embodiment of this disclosure will be described below in connection with the pixel circuit as shown in FIG. 2 and the operation sequence diagram of the control signal as shown in FIG. 4. In the following, for example, transistors in the pixel circuit are described by taking P-type transistors as an example. Particularly, values of the control signals S1, S2 and S3 in three phases of t1~t3 as shown in FIG. 4 are selected as examples for explanation. In the following description, 1 represents a high level signal, while 0 represents a low level signal.

In the phase of t1, i.e., the initialization phase, let S1=0, S2=1, S3=1. Since S1=0, in the pixel circuit as shown in FIG. 2, the third switch transistor T3 and the fourth switch transistor T4 are turned on. The third switch transistor T3 that is turned on outputs the initialization signal Vref to the first node P1, so as to realize initialization and/or reset of the first node P1. At this point, a potential of the first node P1 is initialized as Vref, for example. The fourth switch transistor T4 that is turned on enables the fifth switch transistor T5 to serve as a diode, and the second node P2 can thus be initialized and/or reset through the first power signal VDD. At this point, a potential of the second node P2 is initialized as for example VDD+Vth, wherein Vth is the threshold voltage of the fifth switch transistor T5. Thus, in the phase of t1, voltages of the two electrodes of the storage capacitor Cst are initialized as Vref and VDD+Vth respectively. Hence, a voltage difference between the two electrodes of the storage capacitor Cst is Vref-VDD-Vth.

In the phase of t2, i.e., the data writing phase, let S1=1, S2=0, S3=1. Since S2=0, the second switch transistor T2 is turned on. The second switch transistor T2 that is turned on outputs the data signal Vdata to the first node P1, so as to realize data writing. At this point, the potential of the first node P1 is changed from Vref to Vdata. According to the principle of charge conservation, the potential of the other electrode (i.e., the second node P2) of the storage capacitor Cst becomes Vdata+VDD+Vth-Vref.

In the phase of t3, i.e., the light emitting phase, let S1=1, S2=1, S3=0. Since S3=0, the first switch transistor T1 and the sixth switch transistor T6 are turned on. The first switch transistor T1 that is turned on can maintain the potential of the second node P2 unchanged through the first power signal VDD, thereby ensuring that the fifth switch transistor T5, under the control of the stable potential P2, outputs a stable driving current to the source of the sixth switch transistor T6. The sixth switch transistor T6 that is turned on can outputs the driving current outputted from the fifth switch transistor T5 to the input terminal of the light emitting circuit OLED, so as to drive the light emitting circuit OLED to emit light. Particularly, in the phase of t3, the fifth switch transistor T5 outputs the driving current to the source of the sixth switch transistor T6 under the control of the second node P2. As shown in FIG. 2, the voltage of the second node P2 is namely the voltage of the gate of the fifth switch transistor T5. Hence, the driving current generated by the fifth switch transistor T5 is $I=K(Vgs-Vth)^2=K(Vdata+VDD+Vth-Vref-VDD-Vth)^2=K(Vdata-Vref)^2$, wherein K is a constant related to process parameters and geometrical dimension of the fifth switch transistor T5, Vgs is the voltage difference between the gate and the source of the fifth switch transistor T5, and Vth is the threshold voltage of the fifth switch transistor T5. From the above analysis it can be seen that the driving current that enables the light emitting circuit OLED to be turned on is unrelated to the threshold voltage Vth of the driving transistor (i.e., the fifth switch transistor T5), thereby eliminating an impact of variation of the threshold voltage of the driving transistor on the luminance of the light emitting circuit OLED. This improves uniformity of the luminance of the light emitting circuit OLED greatly.

Figure 5:
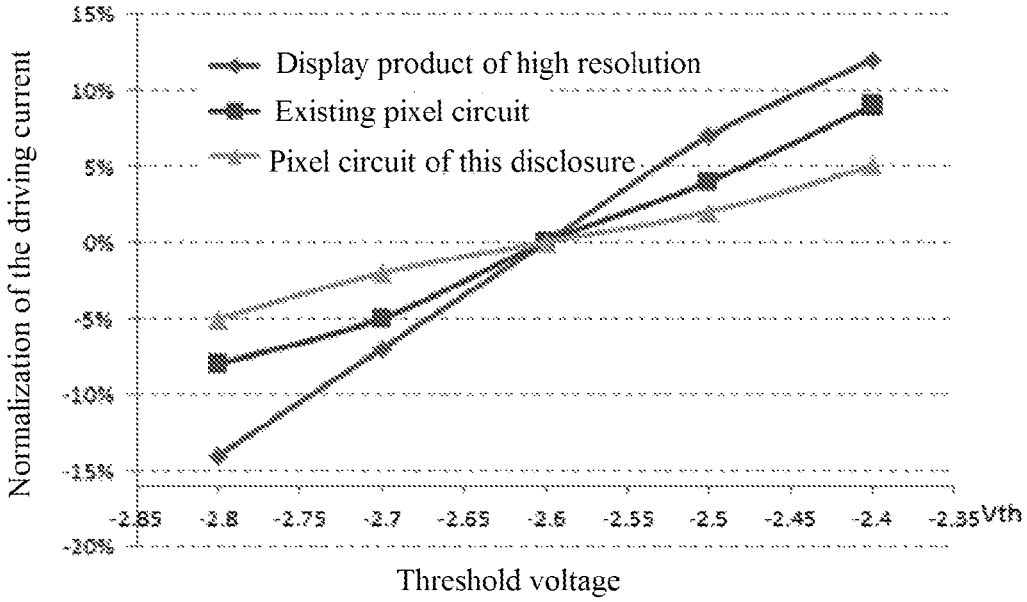
FIG. 5 is a comparison schematic view of the pixel circuit provided according to an embodiment of this disclosure with the existing pixel circuit in terms of compensation capability.

The comparison result as shown in FIG. 5 can be obtained from simulate comparison of the pixel circuit provided by an embodiment of this disclosure with the existing pixel circuit in terms of compensation characteristic. In FIG. 5, axis x represents the threshold voltage of the transistor, and axis y represents the normalized result of the driving current. Generally, the existing pixel circuit does not include a maintenance circuit (i.e., the first switch transistor T1 and the maintenance capacitor Cmos in the pixel circuit according to an embodiment of this disclosure). It can be seen from FIG. 5 that with the variation of the threshold voltage, the variation of the driving current of the pixel circuit according to an embodiment of this disclosure is minimum, the variation range thereof is from −5% to 5%. However, the variations of the driving currents of the pixel circuit of the prior art and the display product of high resolution in which the pixel circuit of the prior art is applied are relatively large, wherein the variation range of the driving current of the pixel circuit of the prior art is from −10% to 10%, and the variation range of the driving current of the display product of high resolution in which the pixel circuit of the prior art is applied is from −15% to 15%. It is clear that, the pixel circuit according to an embodiment of this disclosure has a better compensation capability.

Based on the above description, a method for driving the pixel circuit according to an embodiment of this disclosure as shown in FIGS. 1 and 2 can be obtained. The method for driving the pixel circuit according to an embodiment of this disclosure will be explained below by way of example.

In one embodiment, the method for driving the pixel circuit according to an embodiment of this disclosure comprises: in the initialization phase, the initialization circuit 02 outputting the initialization signal Vref to the first node P1, and the driving circuit 04 initializing the second node P2 through the first power signal VDD. The method further comprises: in the data writing phase, the charging circuit 01 outputting the data signal Vdata to the first node P1. The method further comprises: in the light emitting phase, the maintenance circuit 03 maintaining the potential of the second node P2 unchanged through the first power signal VDD, the driving circuit 04 outputting the driving current to the control circuit 05, and the control circuit 05 outputting the driving current to the light emitting circuit OLED so as to drive the light emitting circuit OLED to emit light.

In one embodiment, in the initialization phase, the initialization circuit 02 outputs the initialization signal Vref to the first node P1 under the control of the first control signal S1, and the driving circuit 04 initializes the second node P2 through the first power signal VDD under the control of the first control signal S1. In one embodiment, in the data writing phase, the charging circuit 01 outputs the data signal Vdata to the first node P1 under the control of the second control signal S2. In one embodiment, in the light emitting phase, the maintenance circuit 03 maintains the potential of the second node P2 unchanged through the first power signal VDD under the control of the third control signal S3, the driving circuit 04 outputs the driving current to the control circuit 05 under the control of the second node P2, and the control circuit 05 outputs the driving current outputted from the driving circuit 04 to the light emitting circuit OLED under the control of the third control signal S3, so as to drive the light emitting circuit OLED to emit light.

In one embodiment, the first control signal S1, the second control signal S2 and the third control signal S3 play a control function when they are of low level.

In one embodiment, in the pixel circuit according to an embodiment of this disclosure as shown in FIG. 2, in the initialization phase, the first control signal S1 is enabled to be a low level signal, and the third switch transistor T3 and the fourth switch transistor T4 are turned on under the control of the first control signal S1. The third switch transistor T3 that is turned on outputs the initialization signal Vref to the first node P1, and the fourth switch transistor T4 that is turned on enables the fifth switch transistor T5 to serve as a diode, thereby initializing the second node P2 through the first power signal VDD. In the data writing phase, the second control signal S2 is enabled to be a low level signal, and the second switch transistor T2 is turned on under the control of the second control signal S2. The second switch transistor T2 that is turned on outputs the data signal Vdata to the first node P1. In the light emitting phase, the third control signal S3 is enabled to be a low level signal, and the first switch transistor T1 and the sixth switch transistor T6 are turned on under the control of the third control signal S3. The first switch transistor T1 that is turned on maintains the potential of the second node P2 unchanged through the first power signal VDD. The sixth switch transistor T6 that is turned on outputs the driving current outputted from the fifth switch transistor T5 to the light emitting circuit OLED, so as to drive the light emitting circuit OLED to emit light.

The method for driving the pixel circuit provided according to an embodiment of this disclosure can implement the function of normally driving the light emitting circuit to emit light, through the charging circuit, the initialization circuit, the maintenance circuit, the driving circuit and the control circuit in corresponding operating phases. Particularly, the maintenance circuit can maintain the potential of the second node unchanged in the light emitting phase, thereby ensuring that the driving circuit can output a stable driving current under the control of the stable second node so as to drive the light emitting circuit to emit light. This helps improving the compensation characteristic of the pixel circuit.

According to an embodiment of this disclosure, a display panel is provided, comprising the pixel circuit as described above.

It is clear that, the skilled person in the art can make various modifications and variations to this disclosure without departing from the spirit and the scope of this disclosure. In this way, provided that these modifications and variations of this disclosure belong to the scope of the claims of this disclosure and the equivalent technologies thereof, this disclosure is also intended to encompass these modifications and variations.

The invention claimed is:

1. A pixel circuit, comprising:

an initialization module for outputting an initialization signal to a first node in an initialization phase;

a driving module for initializing a second node through a first power signal in the initialization phase and outputting a driving current to a control module in a light emitting phase;

a charging module for outputting a data signal to the first node in a data writing phase;

the control module for receiving the driving current from the driving module and outputting it to a light emitting module in a light emitting phase; and the light emitting module for receiving the driving current from the control module to emit light;

wherein the pixel circuit further comprises:

a maintenance module for maintaining a potential of the second node through the first power signal in the light emitting phase;

wherein, the initialization module comprises a control terminal for receiving a first control signal, an input terminal for receiving the initialization signal and an output terminal connected with the first node, and wherein the initialization module outputs the initialization signal to the first node under the control of the first control signal;

the charging module comprises a control terminal for receiving a second control signal, an input terminal for receiving the data signal and an output terminal connected with the first node, and wherein the charging module outputs the data signal to the first node under the control of the second control signal;

the maintenance module comprises a control terminal for receiving a third control signal, an input terminal for receiving the first power signal, and an output terminal connected with the second node, and wherein the maintenance module maintains the potential of the second node through the first power signal under the control of the third control signal;

the driving module comprises a first control terminal connected with the second node, a second control terminal for receiving the first control signal, a first input terminal for receiving the first power signal, a second input terminal connected with the first node, and an output terminal connected with the control module, and wherein the driving module initializes the second node through the first power signal under the control of the first control signal, and outputs the driving current to the control module under the control of the second node;

the control module comprises a control terminal for receiving the third control signal, an input terminal for receiving the driving current from the driving module, and an output terminal connected with the light emitting module, and wherein the control module outputs the driving current outputted by the driving module to the light emitting module under the control of the third control signal so as to drive the light emitting module to emit light;

the light emitting module comprises a first input terminal for receiving the driving current from the control module, and a second input terminal for receiving the second power signal, and wherein the light emitting module emits light under the control of the driving current.

2. The pixel circuit as claimed in claim 1, wherein the maintenance module comprises a first switch transistor and a maintenance capacitor, a gate of the first switch transistor is configured for receiving the third control signal, a source of the first switch transistor is configured for receiving the first power signal, and a drain of the first switch transistor is connected with one of two electrodes of the maintenance capacitor, and the other of the two electrodes of the maintenance capacitor is connected with the second node.

3. The pixel circuit as claimed in claim 2, wherein one of the two electrodes of the maintenance capacitor is arranged on an electrode layer of the first switch transistor, and the other of the two electrodes of the maintenance capacitor is arranged on a metal layer of the first switch transistor.

4. The pixel circuit as claimed in claim 3, wherein the charging module comprises a second switch transistor, and wherein a gate of the second switch transistor is configured for receiving the second control signal, a source of the second switch transistor is configured for receiving the data signal, and a drain of the second switch transistor is connected with the first node.

5. The pixel circuit as claimed in claim 1, wherein the initialization module comprises a third switch transistor, and wherein a gate of the third switch transistor is configured for receiving the first control signal, a source of the third switch transistor is configured for receiving the initialization signal, and a drain of the third switch transistor is connected with the first node.

6. The pixel circuit as claimed in claim 1, wherein the driving module comprises a fourth switch transistor, a fifth switch transistor and a storage capacitor, and wherein a gate of the fourth switch transistor is configured for receiving the first control signal, a source of the fourth switch transistor is connected with a drain of the fifth switch transistor and the input terminal of the control module, a drain of the fourth switch transistor is connected with the second node, one of two electrodes of the storage capacitor and a gate of the fifth switch transistor, a source of the fifth switch transistor is configured for receiving the first power signal, and the other of the two electrodes of the storage capacitor is connected with the first node.

7. The pixel circuit as claimed in claim 1, wherein the control module comprises a sixth switch transistor, and wherein a gate of the sixth switch transistor is configured for receiving the third control signal, a source of the sixth switch transistor is connected with the output terminal of the driving module, and a drain of the sixth switch transistor is connected with the input terminal of the light emitting module.

8. A pixel circuit, comprising:

an initialization module for outputting an initialization signal to a first node in an initialization phase;

a driving module for initializing a second node through a first power signal in the initialization phase and outputting a driving current to a control module in a light emitting phase;

a charging module for outputting a data signal to the first node in a data writing phase;

the control module for receiving the driving current from the driving module and outputting it to a light emitting module in a light emitting phase; and the light emitting module for receiving the driving current from the control module to emit light;

wherein the pixel circuit further comprises:

a maintenance module for maintaining a potential of the second node through the first power signal in the light emitting phase, wherein the maintenance module comprises a first switch transistor and a maintenance capacitor, the charging module comprises a second switch transistor, the initialization module comprises a third switch transistor, the driving module comprises a fourth switch transistor, a fifth switch transistor and a storage capacitor, and the control module comprises a sixth switch transistor; and wherein, a gate of the first switch transistor is configured for receiving a third control signal, a source of the first switch transistor is configured for receiving the first power signal, and a drain of the first switch transistor is connected with one of two electrodes of the maintenance capacitor;

the other of the two electrodes of the maintenance capacitor is connected with the second node;

a gate of the second switch transistor is configured for receiving a second control signal, a source of the second switch transistor is configured for receiving the data signal, and a drain of the second switch transistor is connected with the first node;

a gate of the third switch transistor is configured for receiving the first control signal, a source of the third switch transistor is configured for receiving the initialization signal, and a drain of the third switch transistor is connected with the first node;

a gate of the fourth switch transistor is configured for receiving the first control signal, a source of the fourth switch transistor is connected with a drain of the fifth switch transistor and a source of the sixth switch transistor, and a drain of the fourth switch transistor is connected with the second node;

a gate of the fifth switch transistor is connected with the second node, a source of the fifth switch transistor is configured for receiving the first power signal, and the two electrodes of the storage capacitor are connected with the first node and the second node respectively;

a gate of the sixth switch transistor is configured for receiving the third control signal, a drain of the sixth switch transistor is connected with the input terminal of the light emitting module;

the output terminal of the light emitting module is configured for receiving a second power signal.

9. A driving method of a pixel circuit, the pixel circuit comprising:

an initialization module for outputting an initialization signal to a first node in an initialization phase;

a driving module for initializing a second node through a first power signal in the initialization phase and outputting a driving current to a control module in a light emitting phase;

a charging module for outputting a data signal to the first node in a data writing phase;

the control module for receiving the driving current from the driving module and outputting it to a light emitting module in a light emitting phase; and the light emitting module for receiving the driving current from the control module to emit light;

wherein the pixel circuit further comprises:

a maintenance module for maintaining a potential of the second node through the first power signal in the light emitting phase;

wherein the method comprises:

in the initialization phase, the initialization module outputting the initialization signal to the first node, and the driving module initializing the second node through the first power signal;

in the data writing phase, the charging module outputting the data signal to the first node; and in the light emitting phase, the maintenance module maintaining the potential of the second node through the first power signal, the driving module outputting the driving current to the control module, and the control module outputting the driving current to the light emitting module so as to drive the light emitting module to emit light;

wherein, in the initialization phase, the initialization module outputs the initialization signal to the first node under the control of the first control signal, and the driving module initializes the second node through the first power signal under the control of the first control signal;

in the data writing phase, the charging module outputs the data signal to the first node under the control of the second control signal;

in the light emitting phase, the maintenance module maintains the potential of the second node through the first power signal under the control of the third control signal; the driving module outputs the driving current to the control module under the control of the second node; and the control module outputs the driving current to the light emitting module under the control of the third control signal so as to drive the light emitting module to emit light.

10. The driving method as claimed in claim 9, wherein the first control signal, the second control signal and the third control signal are all low level signals.

11. A driving method of the pixel circuit as claimed in claim 8, comprising:

in the initialization phase, enabling the first control signal to be a low level signal;

enabling the third switch transistor and the fourth switch transistor to be turned on under the control of the first control signal;

the third switch transistor that is turned on outputting the initialization signal to the first node;

the fourth switch transistor that is turned on enabling the fifth switch transistor to serve as a diode, so as to initialize the second node through the first power signal;

in the data writing phase, enabling the second control signal to be a low level signal;

enabling the second switch transistor to be turned on under the control of the second control signal, the second switch transistor that is turned on outputting the data signal to the first node and charging the storage capacitor;

in the light emitting phase, enabling the third control signal to be a low level signal;

enabling the first switch transistor and the sixth switch transistor to be turned on under the control of the third control signal;

the first switch transistor that is turned on maintaining the potential of the second node through the first power signal and the maintenance capacitor;

the sixth switch transistor that is turned on outputting the driving current outputted by the fifth switch transistor to the light emitting module, so as to drive the light emitting module to emit light.

* * * * *